United States Patent [19]

McGrath et al.

[11] 4,079,510

[45] Mar. 21, 1978

[54] METHOD OF MANUFACTURING FLEXIBLE ELECTRICAL CONDUCTOR

[75] Inventors: Kenneth W. McGrath, Attleboro; David W. Marshall, North Reading, both of Mass.; William R. O'Day, Jr., Brookfield, Wis.; Thomas C. Wilder, Cambridge, Mass.

[73] Assignee: Kennecott Copper Corporation, New York, N.Y.

[21] Appl. No.: 716,840

[22] Filed: Aug. 23, 1976

[51] Int. Cl.[2] ..... H01B 13/00; H01B 13/02

[52] U.S. Cl. ..... 29/624; 29/419 R; 156/50; 174/126 R; 174/128 R; 174/129 R; 204/13; 204/209

[58] Field of Search ..... 29/624, 419; 174/128 R, 174/129 R, 126 R; 156/47, 50; 204/35 R, 13, 209; 57/167, 165, 150, 144, 140 J, 166; 228/130, 131, 156, 178, 190

[56] References Cited

U.S. PATENT DOCUMENTS

| | | | |
|---|---|---|---|
| 1,089,684 | 3/1914 | Stone | 174/128 R |
| 1,943,087 | 1/1934 | Potter et al. | 174/128 R X |
| 1,996,689 | 4/1935 | Rohs | 57/166 X |
| 2,975,110 | 3/1961 | Weeber et al. | 174/126 R X |
| 3,312,773 | 4/1967 | Lit | 174/126 R X |
| 3,778,993 | 12/1973 | Glushko et al. | 57/166 X |
| 3,929,610 | 12/1975 | Wang | 204/13 |

FOREIGN PATENT DOCUMENTS

| | | | |
|---|---|---|---|
| 869,065 | 4/1971 | Canada. | |
| 819,680 | 9/1959 | United Kingdom | 156/50 |

*Primary Examiner*—Victor A. DiPalma
*Attorney, Agent, or Firm*—John L. Sniado; Anthony M. Lorusso

[57] ABSTRACT

Disclosed is an electrical conductor formed from a plurality of elongate filaments, at least a portion of which have a non-circular cross section, the filaments arranged such that the conductor has a substantially smooth exterior surface and high density of material of the filaments in a cross section through the conductor perpendicular to its axis. A preferred method for forming such an electrical conductor involves the continuous electroforming of a plurality of elongate conductive filaments. After such filaments are stripped from a cathode track upon which they are deposited, a number of them are bunched and/or twisted together to form an electrically conductive strand. Finally, that strand is compacted to reduce its cross sectional area to provide it with a smooth exterior surface.

11 Claims, 8 Drawing Figures

FIG. 4A
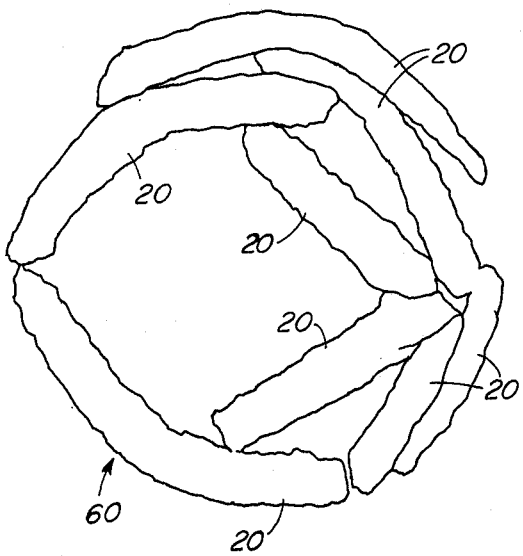
FIG. 4B
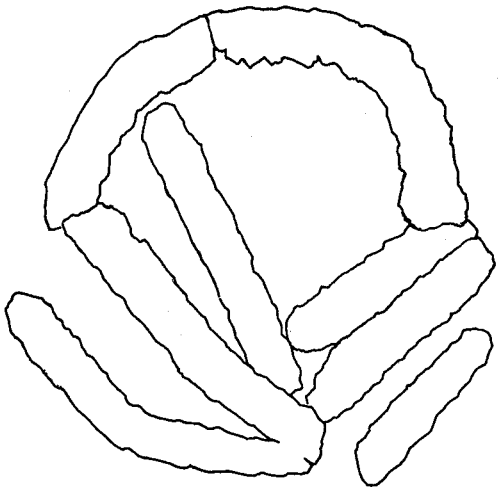
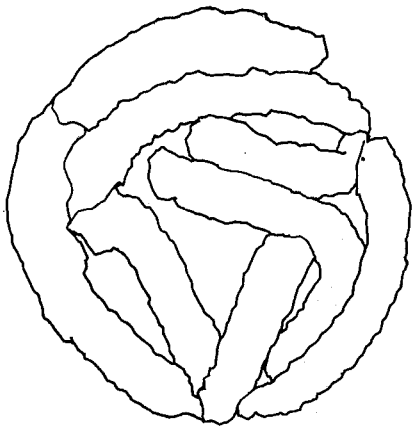
FIG. 4C
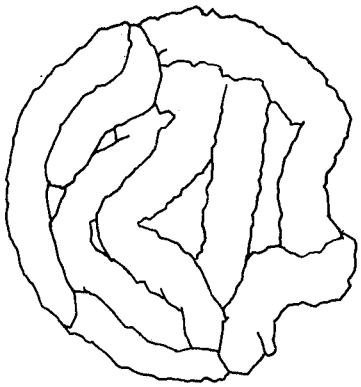
FIG. 4D
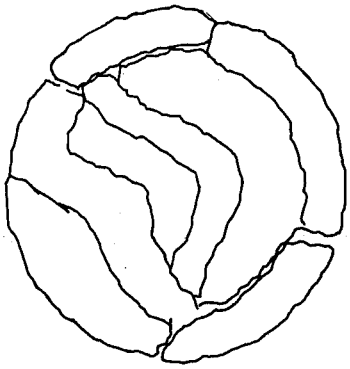
FIG. 4E

METHOD OF MANUFACTURING FLEXIBLE ELECTRICAL CONDUCTOR

BACKGROUND OF THE INVENTION

The present invention relates to an electrical conductor and to a method of fabricating such a conductor.

The structure, and the method of fabrication, of flexible multi-filament electrical conductors has not changed substantially in over 50 years. The individual filaments have been of circular cross section and have been manufactured in a time-consuming, energy- and capital-intensive manner. As is well known to those skilled in the art, an array of mineral processing and pyrometallurgical steps and procedures has been employed to yield copper in the form of "wire bar," which is of relatively hefty cross section. A further array of mechanical steps is then required to reduce the wire bar to the individual fine filaments that are desired. Typically, these mechanical steps include a multiplicity of drawing steps through a large series of dies of progressively smaller size. The drawing steps may be, if required, interspersed with one or more annealing steps. As is also well known to those skilled in the art, as the desired filament diameter is reduced, the capital expenses per pound of material processed required to achieve these mechanical steps increases rapidly.

Furthermore, once the desired circular cross sectional filaments have been obtained, the twisting together of such filaments results in an electrical conductor in which the void content accounts for approximately 25% to 30% of the cross sectional area. This, of course, results in a relatively large diameter stranded wire for a given current carrying capacity, a feature which increases insulation expenses and renders the conductor bulky and difficult to utilize in various electrical systems.

A relatively recently proposed modification of the final steps of manufacturing conventional stranded wire is disclosed in U.S. Pat. No. 3,786,623. There, a circular cross section wire is produced in a conventional manner having a diameter in the range of 1.5 mm to 15 mm. This relatively large wire is flattened to a strip or band which then passes through a shearing device to yield a number of individual strands which are then twisted together, in a conventional manner to form the final wire. This proposal, of course, does not eliminate the great majority of the pyrometallurgical and mechanical processing steps of conventional techniques and apparently has as its main alleged advantage the elimination of the large masses of the several reels supported on the twisting machine.

Canadian Pat. No. 869,065, issued Apr. 20, 1971, entitled "Method of Producing Copper Wire" teaches various techniques for producing strips of copper wire by electrodeposition in a form suitable for feeding into conventional wire drawing apparatus. Much of the teaching of the patent is directed to achieving a desirable cross sectional shape for the individual wire strands produced by the electrodeposition. One briefly mentioned technique for producing a desirable cross sectional shape is the welding, by means of pressure, of two or more of the copper strands formed through electrodeposition.

An initial step in the fabrication of stranded wire, according to the present invention, involves the electroformation of electrically conductive filaments. Electroformation of electrically conductive filaments has, of course, been known for some time, but has been employed principally in the preparation of various speciality wires and typically has been followed by drawing and/or plating steps to form circular cross section filaments usable as very fine gauge wire. An example of a system for electroformation of metallic strands can be found in Wang U.S. Pat. No. 3,929,610, issued Dec. 30, 1975, entitled "Electroformation of Metallic Strands," assigned to the Assignee of the present invention, and incorporated herein by reference.

In view of the above discussion, it is a principal object of the present invention to provide a flexible elongate electrical conductor, and a technique of manufacturing such a conductor, which is conducive to reductions in the capital and energy requirements necessary to produce such a conductor.

It is a further object to provide such a conductor, and such a method, conductive to the provision of electrical conductor having improved mechanical and/or electrical properties compared to conventionally produced conductor of equivalent current rating.

SUMMARY OF THE INVENTION

In one aspect, the present invention features a method of fabricating a flexible elongate electrically conductive strand comprising the steps of electrodepositing an electrically conductive material continuously on an endless cathode track; stripping lengths of said electrically conductive material from the cathode track; bunching and/or twisting together a plurality of those lengths as plated to form an electrically conductive strand; and compacting that electrically conductive strand to reduce its cross sectional area and to provide a smooth exterior surface on the electrically conductive strand. Preferably, the electrically conductive material is copper; a plurality of electrically conductive lengths are electrodeposited on one or more cathodes at the same time; the lengths are then bunched so as to produce a flexible conductor.

In another aspect, the invention features an elongate electrical conductor formed from a plurality of individual elongate filaments, at least a portion of the filaments having a non-circular cross section. The filaments are arranged such that the conductor has a substantially smooth exterior surface and an average cross section having less than about 25% voids. Preferably, all of the elongate filaments have an irregular cross section and are compacted such that an average cross section of the conductor has less than about 10% voids.

BRIEF DESCRIPTION OF THE DRAWINGS

Other objects, features, and advantages of the invention will appear from the following description of particular preferred embodiments and techniques, as illustrated in the accompanying drawings. In the drawings:

FIGS. 4A–4E are cross sectional illustrations (with sectioning lines omitted) of a multiple-filament, stranded electrical conductor undergoing the final compacting steps of the method depicted in FIG. 1.

DETAILED DESCRIPTION OF PREFERRED EMBODIMENTS AND TECHNIQUES

GENERAL

Figure 1:
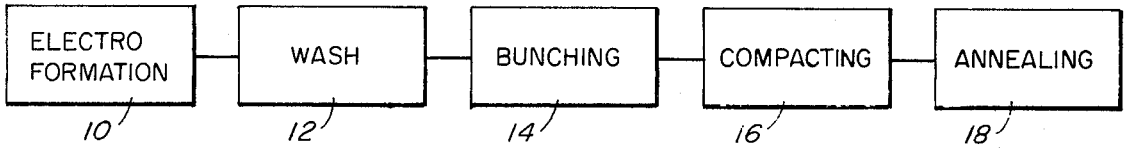
FIG. 1 is a flow chart indicating the steps in a technique according to the present invention, for manufacturing elongate flexible electrical conductor.

The discussion below is addressed to the manufacture of an electrical conductor formed of copper, since copper is the most common conductor material. The method of fabricating the desired stranded electrical conductor involves the electroformation of individual copper filaments and bunching and/or twisting or braiding of a plurality of those filaments into a stranded conductor. The individual copper filaments can be produced by electroplating on a continuous, closed-loop plating track of a stationary cathode, in a manner taught in the above-mentioned Wang U.S. Pat. No. 3,929,610. Because the copper is deposited on generally planar plating tracks, the filaments are non circular in cross section. The cross section of the filaments are trapezoidal or half-elliptical in nature with the bottom side flat as deposited on the planar plating track. The top side may be generally flat with rounded shoulders or approach the shape of one-half of an ellipse.

Heretofore, this shape has been viewed as a detriment, requiring corrective steps (e.g., drawing the individual filaments). According to the present invention, however, it has been realized that not only can the direct fabrication of a stranded electrical conductor from electroformed filaments substantially reduce the number of mechanical processing steps, but the irregular and non-circular shapes of the individual filaments are conducive to a compacting of the stranded conductor so as to provide a conductor having a considerably smaller percentage of voids in its cross section than in previous conventional stranded conductors. This reduction in voids, of course, permits a smaller size conductor for a given current carrying capacity, thereby reducing insulation costs, lessening the bulk of the wire to simplify both storage and usage problems, etc.

Thus, in accordance with the present invention, a number of the electroformed filaments are first bunched and/or twisted together to form, at this intermediate stage, a stranded conductor of irregular shape and cross section and having a large percentage of void in any cross section. The bunched and/or twisted or braided strand is then compacted to form a smooth-surfaced, flexible conductor having a very low percentage of voids in its cross section. Because of the non-circular cross sectional shapes of the individual filaments, they are more susceptable to deformation during the compacting steps and can be caused to conform to the shapes of each other thereby eliminating the substantial voids that are inherent in any packing of circular cross section filaments.

It is contemplated within the scope of this invention that the flexible elongate electrically conductive strand may be produced without twisting the filaments together. Thus the term "bunched" is used to indicate that the electroformed filaments are laid parallel with respect to each other and compacted to form the strand without twisting. In another embodiment the electroformed filaments are twisted together to form an irregular shaped cross section conductor and then compacted to form a smooth surfaced flexible conductor.

Another substantial advantage of the process just described is that it permits the direct manufacture of a copper conductor product from crude copper input material. More specifically, the anodes in the electroforming stage of the process may not only be copper refinery cathodes or anodes, but can actually be sheared anode scrap or "number one" copper scrap supported in an inert metal (e.g., titanium) basket in the electrolyte, as illustrated in the above mentioned U.S. Pat. No. 3,929,610. With such input material, a variety of costly prior art process steps are avoided in the preparation of the copper filaments, including: melting of scrap, anode casting, electro-refining, melting of the cathodes, wire bar or wire rod casting, breakdown of wire rod or wire bar, and a multiplicity of drawing steps. One way to view the present invention is that all of these steps, many of which require very expensive installations and high energy requirements, are eliminated at the cost of the compacting step of the present invention (a step typically not required in the prior art).

The Drawings

The basic process steps for manufacturing an electrical conductor in accordance with the present invention are shown in FIG. 1. First, individual electrically conductive (i.e., copper) filaments are produced by electroformation techniques generally as described in the above-mentioned U.S. Pat. No. 3,929,610, and discussed in further detail below. The electro-formed filaments are continuously stripped from cathodes immersed in an electrolytic solution in the step indicated at reference numerial 10 and are preferably immediately washed as at 12, to remove any residual electrolyte prior to further processing steps. Since the remaining process steps will typically take place at different locations in a manufacturing plant, the filaments will typically, but not necessarily, be wound on a storage spool after they have been washed. A number of filament spools (e.g., four) are then employed as inputs to a bunching or twisting device of any conventional design, as indicated at step 14. The resulting stranded wire is then compacted at step 16 employing swaging or drawing techniques. A final annealing step 18 is found to relieve cold working stresses and to increase the flexibility of the final compacted, stranded electrical conductor. (As will be understood by those skilled in the art, intermediate annealing treatments may be desirable prior to the bunching step 14 and the compacting step 16.)

Figure 2:
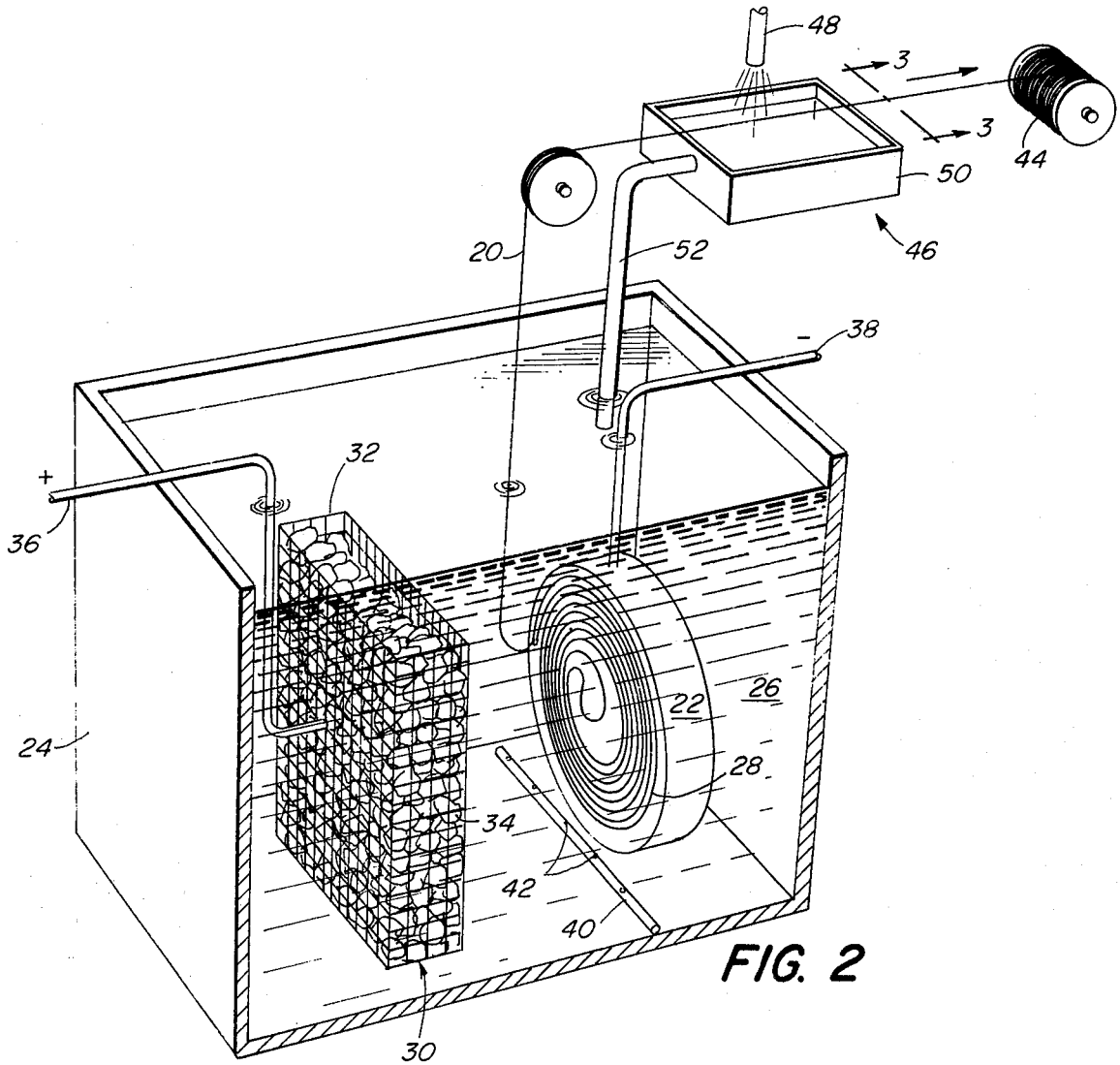
FIG. 2 is a partially schematic illustration of apparatus for accomplishing certain steps of the technique of FIG. 1.

The electroformation step 10 and washing step 12 may be better understood with reference to the somewhat schematic FIG. 2, which illustrates a pilot set-up. It is anticipated that various design changes would be employed in any scale-up to a commercial plant operation. Some of the changes are discussed below.

Referring to FIG. 2, a filament 20 is formed on a cathode 22 immersed in a plating tank 24 containing an electrolytic solution 26. The cathode 22 preferably has a continuous, closed-loop plating track 28 upon which the filament 20 is formed. A suitable configuration of such a track 28 is the closed-loop, double spiral track illustrated in FIG. 3 of the above-mentioned U.S. Pat. No. 3,929,610. Also immersed in the electrolyte 26 is an anode 30 that is spaced apart from the cathode 22 and oriented in a vertical plane substantially parallel to the vertical plane of the cathode. The anode 30 preferably comprises a metallic (titanium) basket 32 containing lumps of copper 34, which may be of relatively low grade. Electrical leads 36 and 38 connect the anode and the cathode, respectively, to the positive and negative terminals of a direct current power supply. An air supply line 40 in immersed in the tank 24 adjacent the bottom edge of the vertically disposed cathode face. Conventional air line connections are provided (not shown) to deliver water saturated compressed air to the line 40 for release through nozzle openings 42 to provide air-agitation of the electrolyte 26 to increase the plating rate at the cathode face. Not illustrated are conventional plumbing and other fittings which maintain the electrolyte at a suitable level, temperature and chemical composition.

The filament 20 is pulled from the cathode face by a driven take-up spool 44 at a rate determined by the plating rate on a cathode track 28. With a proper matching of the plating rate and the stripping rate, a filament 20 of a relatively uniform cross section can be produced.

The spool 44 pulls the formed filament 20 through a washing station 46 comprising a water nozzle 48 connected to a regulated water supply line (not shown) and a collection trough 50 disposed beneath the filament 20. The electrolyte recovered from the filament 20 by the washing operation can be recycled by provision of a conduit 52 returning the electrolyte/water solution to the tank 24. (The conventional controls, mentioned above, for maintaining the appropriate chemical composition of electrolyte 26 will compensate for any dilution of the electrolyte owing to the delivery of the washing water, as well as the electrolyte, to the tank 24.)

In a commerical plant, the tank 24 could be substantially larger and would probably be extended in a direction parallel to the axis of the cathode 22 to permit a plurality of anodes 30 and/or cathodes 22 to be supported in a single tank. In particular, it is anticipated that a series of regularly spaced anodes and cathodes could be provided along the length of such an enlarged tank, with the cathodes having plating tracks 28 on each cathode face and with anodes 30 having their opposite faces disposed parallel to the faces of two adjacent cathodes. Futhermore, as explained in the contemporaneously filed patent application entitled "Multiple Track Cathode for Electroformation of Metallic Filaments," owned by the Assignee hereof, it may be desirable to provide a plating track arrangement on each face of each cathode that can yield a plurality of filaments. As explained in that patent application, such filaments may be either independent or fused to each other at spaced apart locations along their lengths, depending upon the particular cathode track pattern employed.

Figure 3:
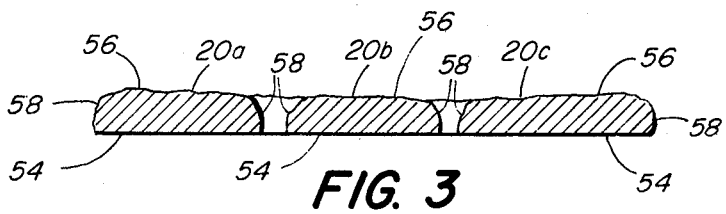
FIG. 3 is a greatly enlarged cross sectional illustration (section line 3—3 of FIG. 2) of individual filaments after manufacture in accordance with initial steps of the method illustrated in FIGS. 1 and 2.

As mentioned above, the filaments produced in the electroforming step have a non-circular cross section. These non-circular cross section filaments are half-ellipitical or trapezoidal with rounded shoulders. FIG. 3 is an illustration based upon a photographic enlargement of three copper filaments that were simultaneously electroformed on a single cathode face in accordance with the general description above relating to FIG. 2. As is evident from FIG. 3, each of the filaments 20*a*, 20*b*, 20*c* has a generally flat edge 54 that was formed in contact with the plating track on the cathode and a upper surface 56 typically rounded at its edges 58. These filaments can, as mentioned above, be simultaneously formed on a single cathode face having a plating track pattern that causes the individual filaments 20*a*, 20*b*, 20*c* to be fused at spaced apart locations along their lengths, thereby facilitating handling of the typically delicate individual filaments.

EXAMPLE

A cathode was prepared having a plating track pattern that yielded three filaments, such as shown in FIG. 2, attached to each other at spaced apart locations along their lengths. The filaments were stripped at a rate of about 360 inches per hour from the face of an 11 inch diameter cathode immersed in a water-saturated, air-agitated electrolytic bath such as illustrated in FIG. 2. The stripped filaments were washed and then spooled.

Following annealing (210° C for 4 hours), four reels of such triplet filaments were placed on a conventional twisting machine that twisted the triplet filaments together to form a rough circular strand of about 60 mils in diameter. The speed of the twisting machine was such that about 6 twists per inch were formed.

As is evident from FIG. 4A, the resulting rough, bunched strand 60 has a very irregular cross section, is formed from the individual irregularly-shaped filament 20 cross sections, and includes a very large percentage of voids (e.g., greater than 40%). This wire was then passed through a series of swaging dies, with resulting typical wire cross sections indicated in FIGS. 4B–4E. As is evident from those FIGS., the successive stages of drawing or swaging results, without any substantial reduction in the thickness of the individual filaments, in a smoothing of the exterior surface of the wire as a whole, a reduction in the percentage of inter-filament spacing, and a change in the shape of the individual filaments to accommodate the shapes of adjacent filaments, thereby contributing to both the smooth exterior surface and the elimination of voids. After swaging steps, the resulting wire was annealed (400° C for 4 hours under an argon atmosphere) yielding a final wire, FIG. 4E, that was found to be at least as flexible as conventionally manufactured wire of similar gauge and which could be easily attached to a conventional wire connector. The resulting wire was, additionally, smaller in diameter for a given current carrying capacity, than conventionally manufactured stranded wire.

As is particularly evident from FIG. 4E a multiple-filament conductor constructed in accordance with the present invention has a larger amount of copper per unit cross sectional area than is true of conventional stranded wire which because of the round shape of its individual filaments has a greater void content. This is due to the less efficient packing of the cylindrical strands in conventional stranded wire. For example, 18 gauge stranded conventional wire has a void content of about 29% of the cross sectional area. Typical wire according to the present invention has less than 25% voids. Indeed, one sample of wire formed in accordance with the present invention, having the equivalent current-carrying capacity of conventional 18 gauge wire, had a void content of about 8.5%. This, of course, means that the outer diameter of the bare wire can be considerably smaller than that of conventional stranded wire of the same current rating. Since the wire diameter is smaller, less insulation will be required for wires of equivalent current carrying capacity.

As indicated above, the flexibility of wire produced in accordance with the present invention has been found to be quite good. In fact, some preliminary investigations suggest that the flexibility may actually be greater than that of conventionally formed wire of equivalent current-carrying capacity.

While a particular preferred embodiments and techniques of the present invention have been illustrated in the accompanying drawings and described in detail herein, other embodiments are within the scope of the invention and the following claims.

What is claimed is:

1. A method of fabricating a flexible elongate electrically conductive strand comprising the steps of (a) electrodepositing an electrically conductive material continuously on an endless cathode track to form individual filaments which are non-circular in cross-section with the bottom side of said filament that is deposited on the cathode track being flat and with the top side being generally flat with rounded shoulders between the bottom and top sides, (b) stripping lengths of said filaments from said cathode track, (c) bunching together a plurality of said filaments to form an electrically conductive strand, and (d) compacting said electrically conductive strand formed of said filaments with flat bottoms and rounded shoulders so that filaments conform to the shape of each other to reduce its cross sectional area and to provide a relatively smooth exterior surface along the length of said electrically conductive strand.

2. The method of claim 1 wherein step (c) includes twisting the lengths together.

3. The method of claim 1 wherein said electrically conductive material is copper.

4. The method of claim 3 wherein said electrically conductive material is continously electrodeposited on a plurality of endless cathode tracks and a like plurality of filaments are simultaneously stripped from those cathode tracks.

5. The method of claim 3 wherein said step (d) includes swaging.

6. The method of claim 3 wherein said step (d) includes drawing of said strand through at least one die.

7. The method as claimed in claim 3 wherein there are a plurality of said cathode tracks that intersect each other a multiplicity of times on said cathode, whereby length of said material stripped from said cathode tracks are in the form of strands of a plurality of filaments of said material that are fused periodically along the longitudinal direction of each said length of said material.

8. The method as claimed in claim 7 wherein said step (c) comprises twisting together at least four of said lengths of material.

9. The method of claim 3 wherein said electrically conductive material is annealed after each of said steps (b), (c), and (d).

10. A method of forming a flexible elongated electrical conductor comprising the steps of electroforming a plurality of elongated copper filaments, each filament having a non-circular cross section with the bottom side of said filament that is deposited on the cathode track being flat and with the top side being generally flat with rounded shoulders between the bottom and top sides, bunching together a plurality of said filaments to form a elongate strand having an irregular exterior surface and an average cross section having greater than 40% voids, compacting said strand formed of said filaments with flat bottom and rounded shoulders so that filaments conform to the shape of each other to provide it with a smooth exterior surface and an average cross section having less than 25% voids.

11. The method of claim 10 including the step of twisting together a plurality of said filaments prior to compacting.

* * * * *